United States Patent [19]

Chiron et al.

[11] 3,931,625

[45] Jan. 6, 1976

[54] SHORTENED MULTI-ROD BROADBAND ANTENNA

[75] Inventors: Bernard Chiron; Jean Gelin, both of Paris Cedex, France

[73] Assignee: Societe Lignes Telegraphiques et Telephoniques, Paris Cedex, France

[22] Filed: July 10, 1974

[21] Appl. No.: 487,143

[30] Foreign Application Priority Data

July 18, 1973 France ..... 73.26250

[52] U.S. Cl. ..... 343/787; 343/844; 343/900

[51] Int. Cl.[2] ..... H01Q 9/32

[58] Field of Search ..... 343/787, 844, 846, 893; 343/900

[56] References Cited

UNITED STATES PATENTS 3,550,145 12/1970 Tai ..... 343/893

3,564,551 2/1971 Mills et al. ..... 343/787

*Primary Examiner*—Eli Lieberman

*Attorney, Agent, or Firm*—Kemon, Palmer & Estabrook

[57] ABSTRACT

A multi-rod broadband antenna consisting of a plurality of elementary radiators arranged as directrices of a cylinder each consisting of a conductor surrounded with a ferromagnetic core designed so that each one has a resonant frequency value different from any other one, the resonant frequency values being related so as to form a series. The arrangement of the rods around the cylinder is such that the frequency values of two adjacent rods do not correspond to two adjacent terms of the series.

7 Claims, 9 Drawing Figures

SHORTENED MULTI-ROD BROADBAND ANTENNA

BACKGROUND OF THE INVENTION

The present invention relates to a broadband multielement antenna of the monopole type, i.e. one having end excitation, which has relatively small bulk.

An antenna of this type consists essentially of rodlike elements (wire, metal rod or the like) through which a current is passed and which is generally known as a "whip." The application of the theory of lines to antennas shows that the impedance of the rodlike radiating element as seen from the transmitter (or the receiver) is a function of the ratio between the geometrical length of the element and the wavelength of the radiated energy. The optimum energy coupling conditions between the transmitter (or the receiver) and the radiating elements are those with which the impedance of the element is entirely real and generally in the neighbourhood of 50 ohms (i.e. a geometrical length of about $\lambda/4$ in the case of a monopole). These well-known results assume a sinusoidal distribution of the current in the element. It is deduced that:

1. a radiating rod has a selective impedance which varies rapidly with the frequency, and
2. the geometrical length of the elements is of the same order of magnitude as the wavelength (in vacuum, in the case of non-magnetic metals).

Under these conditions, the problem of the construction of broadband antennas having a limited bulk in the decametric and/or metric bands is particularly complex. It is usual to design antennas operating in these frequency ranges with a conductive cylinder, sometimes hollow, the diameter of which is not negligible as compared with the wavelength (i.e. of a diameter $>\lambda/10$, where $\lambda$ is the wavelength in vacuum), the said cylinder often being produced from an assembly of rodlike elements distributed along the directrices of the surface of the said cylinder and sufficiently close together to ensure electrical continuity of the surface. Calculation of the distribution of current in such an antenna is a very complex problem. As a first approximation, it may be compared to a set of coupled rodlike radiating elements. It is known that thickening of the antenna increases the bandwidth. Tuning in the range is obtained with the aid of impedances of appropriate value which are manually or automatically connected in series with the antenna.

Prior Art

It is known to reduce the geometrical length of an antenna by connecting a fixed lumped impedance to one of the ends of the rod (see Radio Engineers' Handbook by F. E. Terman, published in 1943 by McGraw-Hill, pages 794 and 795). The added impedance does not modify the selectivity of the whip. The Applicants have described a method of broadening the bandwidth of a loaded whip in the French patent No. 1.590.709 filed on Sept. 30th, 1968 and in the U.S. Pat. no. 3.611.390 filed on Oct. 16th, 1969 and entitled: "Wide band rod antenna with impedance matching." These patents describe forms of automatically varying the impedances added to radiating whips, by means of which it is possible to obtain a thin, shortened aerial having a broad bandwidth. These impedances are manufactured from materials whose magnetic and/or dielectric characteristics vary as a function of the frequency in accordance with a given law in the frequency range in which they are operated, either spontaneously or as a result of an external magnetic or electric bias controlled by the current of the antenna. An analysis of the work done by the Applicants up to June, 1972 formed the subject of a lecture by Messrs. B. Chiron and J. Gelin, given on the 10th January, 1973 to the Societe Francaise des Electriciens et Electroniciens, entitled: "Antennes HF chargees de ferrite" and published on that occasion.

Brief disclosure of the invention

The present invention concerns multi-rod antenna structures of the loaded monopole type operating over a number of several octaves in the metric and decametric ranges without the provision of any tuning impedance.

Multi-rod broadband antennas according to the invention are essentially characterized as follows:

1. the values of the resonant frequencies of the various rods are selected in accordance with a simple mathematical law;
2. the rods, ordered in accordance with their natural resonance frequency, are located around the circumference of the cylinder in such manner that they are equidistant and that the rods, taken in the above order, define a star-form polygon, that is to say, that the succession in space does not reproduce the order of succession of the values of the resonant frequency.

In accordance with a preferred variant of the invention, the rods are individually loaded by a fixed load impedance which defines, with the shortened conductor, the resonance frequency of the loaded rod, the values of the said frequencies forming a series defined by a simple law.

In accordance with another variant of the invention, the load of each rod consists of an automatically variable impedance, as specified in the Applicants aforementioned patents. The construction of such a variant is limited by the existence of materials whose magnetic and/or dielectric characteristics make it suitable for use throughout the frequency band covered by the antenna and follow in this band the law of variation mentioned in the said patents and again referred to in the following.

As was explained in the text of the lecture mentioned in the foregoing, the position of the load along the whip modifies the characteristics of the antenna, and specially its effective height. Calculation shows that the effective height of a monopole antenna having a diameter of 4 mm, whose mechanical length is equal to one-half of a quarter-wave and which is loaded by a ferrite core, changes from 0.297 to 0.35 times the length of a quarter-wave depending upon whether the same core is situated at the excited base of the antenna or at its opposite end. Under the same conditions, the value of the resistance varies between 0.6 ohms and 12.3 ohms and the quality factor between about 67 and 40. The resistance of an infinitely thin wire having a mechanical length of a quarter of wavelength is about 40 ohms.

Experience has shown that a distribution of the resonant frequencies in accordance with a geometrical progression gives good results, which are sometimes improved by a logarithmic distribution of the frequencies. The distribution of the rods around the circumference of the cylinder in an order of succession differing from that of the values of the resonant frequencies of the rods is an important condition for obtaining optimum results.

DETAILED DESCRIPTION OF THE INVENTION

The invention will be readily understood from the following description and by reference to the accompanying figures which are given by way of illustration and have no limiting character and in which.

Figure 1:
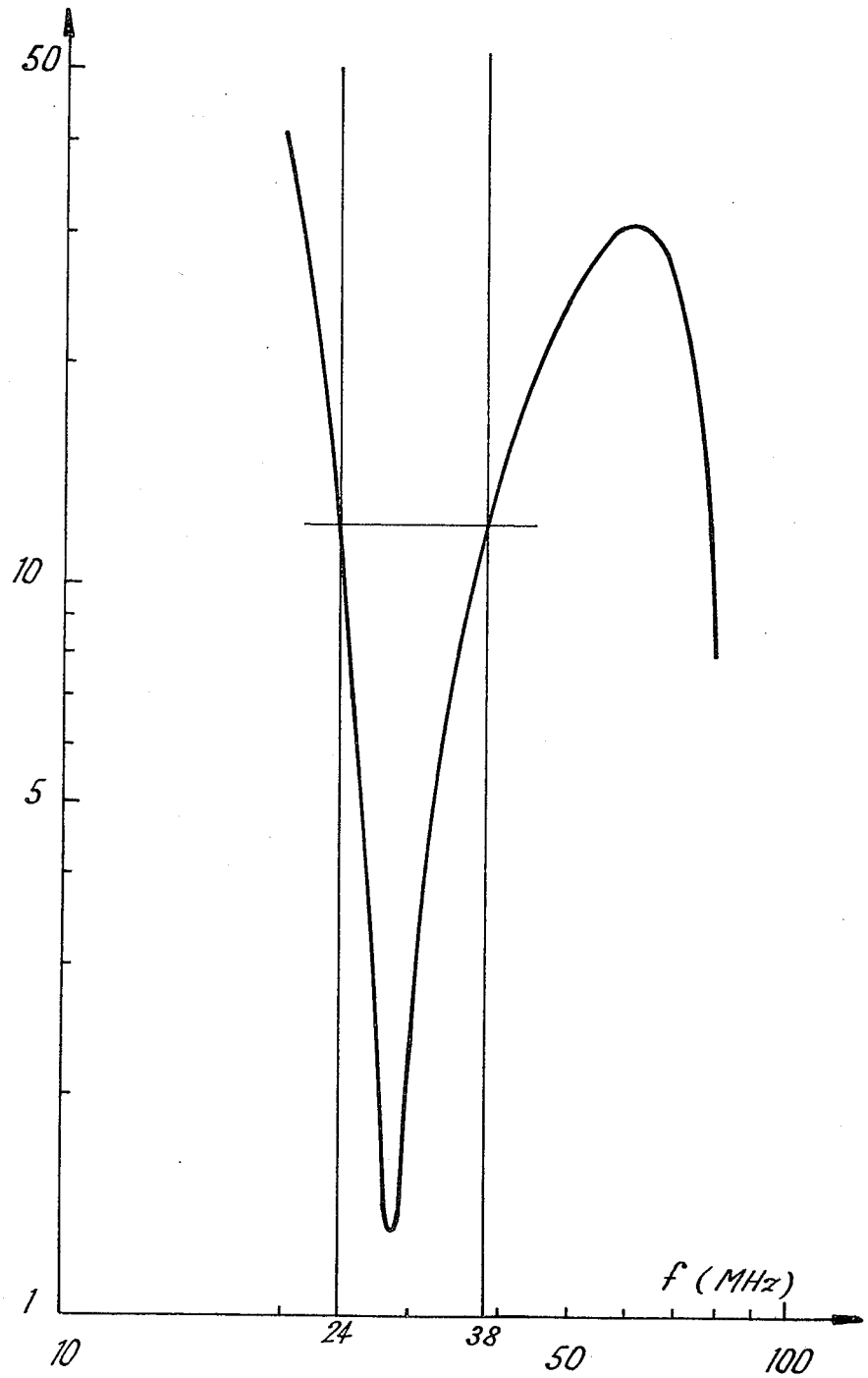
FIG. 1 represents the curve of the standing wave ratio as a function of the frequency of a monopole antenna consisting of a conductive rod tuned to a quarter-wave of the central frequency of the band (30 MHz) given by way of reference.

FIG. 1 illustrates, as a function of frequency, the variations of the standing wave ratio which are presented by a monopole antenna tuned to 30 MHz and consisting of a thin conductor having a length of 2.5 meters and a diameter of 2 mm. As may be seen from the curve, if a maximum standing wave ratio of 12 is assumed, the antenna may be used between about 24 MHz and 38 MHz, which corresponds to a bandwidth of about 50 %, by means of an external matching impedance. It is to be understood that these values are given purely by way of indication, it being rarely possible to assume a standing wave ratio of such high value in transmitting equipment.

Figure 2:
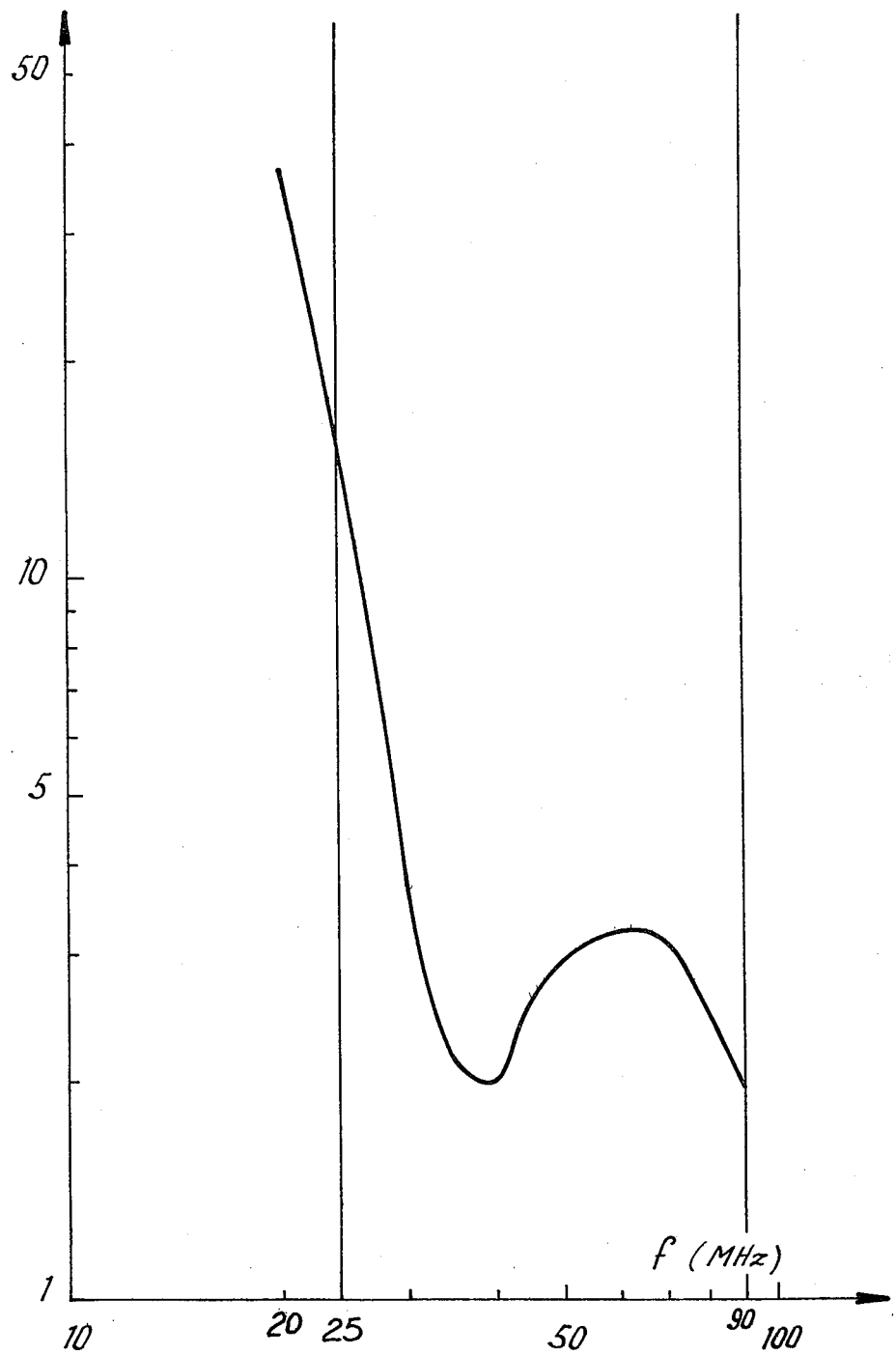
FIG. 2 is the same curve for a thick antenna having a continuous cylindrical surface and a diameter of 300 mm, tuned to the same frequency.

The curve of FIG. 2 illustrates the variation of the s.w.r. for a thick single-rod cylindrical antenna of the same length with a diameter of 300 mm (continuous surface). Assuming the same standing wave ratio of 12 as before it will be seen that the antenna may be used between 25 and 90 MHz, i.e. in a relative bandwidth of 260 %. Therefore, at each operating frequency, the optimum matching impedance, whose value has previously been calculated or measured, should automatically be connected in series with the aerial by an automatic circuit.

These two curves, which correspond to designs known in the prior art, clearly illustrate that the thickening of the radiating structure is accompanied by a widening of the bandwidth.

Figure 3:
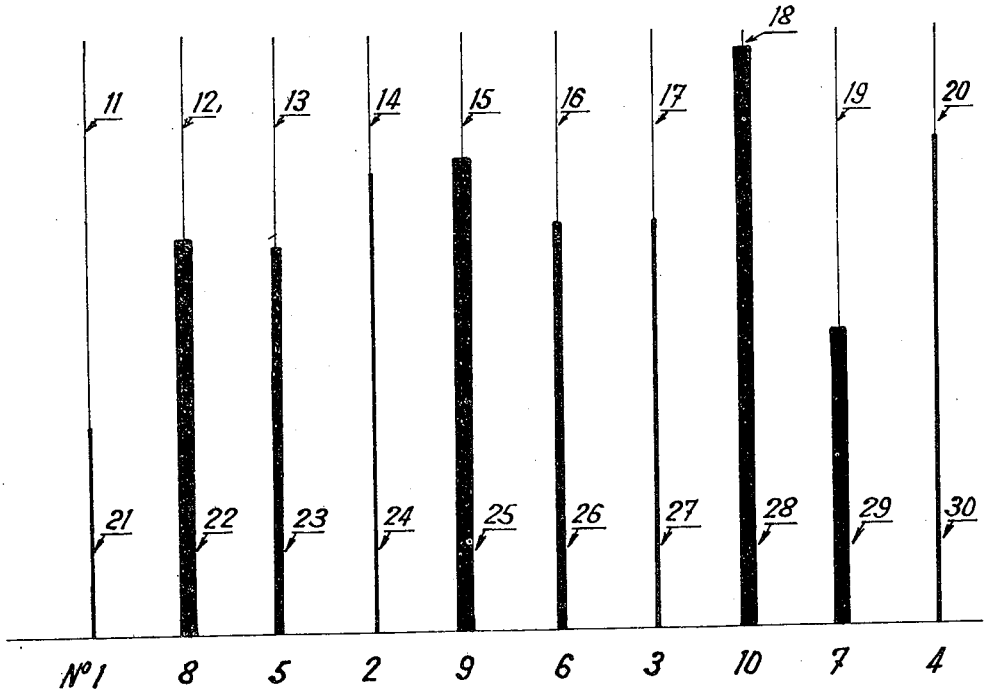
FIG. 3 is a developed view of an antenna according to the invention.

FIG. 3 diagrammatically illustrates an antenna according to the invention, which is intended to cover the 8 – 30 MHz range (i.e. almost two octaves) without matching or tuning. It consists essentially of ten metallic conductors such as 11, 12 . . . having a length of 1.5 meters, which are distributed uniformly around two circumferences of a diameter of 250 mm, i.e. that of a metal disc situated close to the supply point and that of a disc situated at the unexcited end of the rods. This disc is made of dielectric. The metal disc is connected to the supply device by a metal base of a length of 200 mm. The dielectric disc is intended only to ensure mechanical strength of the structure.

In accordance with one of the essential features of the invention, each of the ten rods is associated with a core 21, 22 . . . of ferromagnetic material, whose characteristics (permeability and dimensions) are so chosen that the natural resonance frequency of each of the rods has a value belonging to a series constituting a geometrical progression. In the described example, the following series has been chosen:

$$\frac{F^{N+1}}{F^{N}} = 0.867,$$

where $F^{N+1}$ is the resonance frequency of the rod of order $N^{+}1$.

The different resonance frequencies of the rods are set out in the following table, which also includes the geometrical and magnetic characteristics of the cores associated with each of the rods.

TABLE I

| Rod rank N | $F^N$(MHz) | Material | | Core dimensions | |
|---|---|---|---|---|---|
| | | $\mu$ | Q | $\phi$mm | H mm |
| 1 | 30.000 | 30 | 230 | 3 | 530 |
| 2 | 26.016 | 30 | 230 | 3 | 1150 |
| 3 | 22.560 | 30 | 230 | 6 | 1025 |
| 4 | 19.563 | 30 | 230 | 6 | 1230 |
| 5 | 16.965 | 30 | 230 | 10 | 970 |
| 6 | 14.711 | 30 | 230 | 10 | 1025 |
| 7 | 12.767 | 30 | 230 | 20 | 735 |
| 8 | 11.062 | 100 | 110 | 20 | 980 |
| 9 | 9.563 | 100 | 110 | 20 | 1160 |
| 10 | 8.318 | 100 | 110 | 20 | 1450 |

In this particular embodiment, the values chosen for the frequencies are within the bandwidth. This condition is not essential and some values may be chosen outside the operating band.

Figure 4:
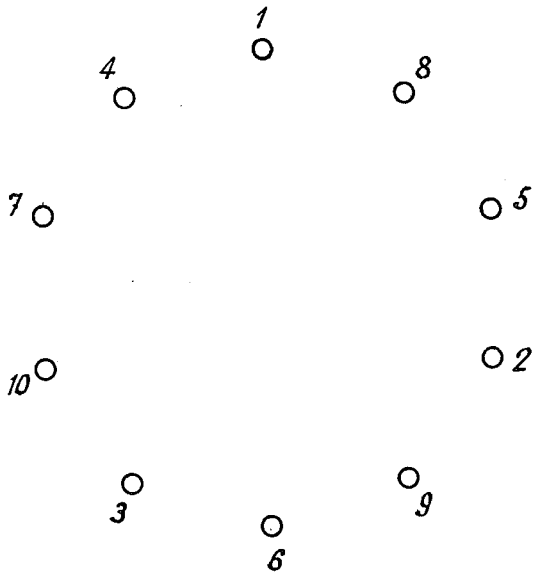
FIG. 4 illustrates the space distribution around the circumference of the whips ordered in accordance with the value of their resonant frequency.

In accordance with a preferred variant of the invention, the rods graded in accordance with the increasing values of their resonance frequency are not adjacent on the circumference of the ssupport discs. The diagram of FIG. 4 illustrates a preferred spatial repartition of the rods numbered from 1 to 10 in accordance with the decreasing order of their resonance frequency, the rank N constituting the first column of the Table I. As will be apparent, if the rods are linked by a line in the order of their rank, a starform polygon is obtained.

Figure 5:
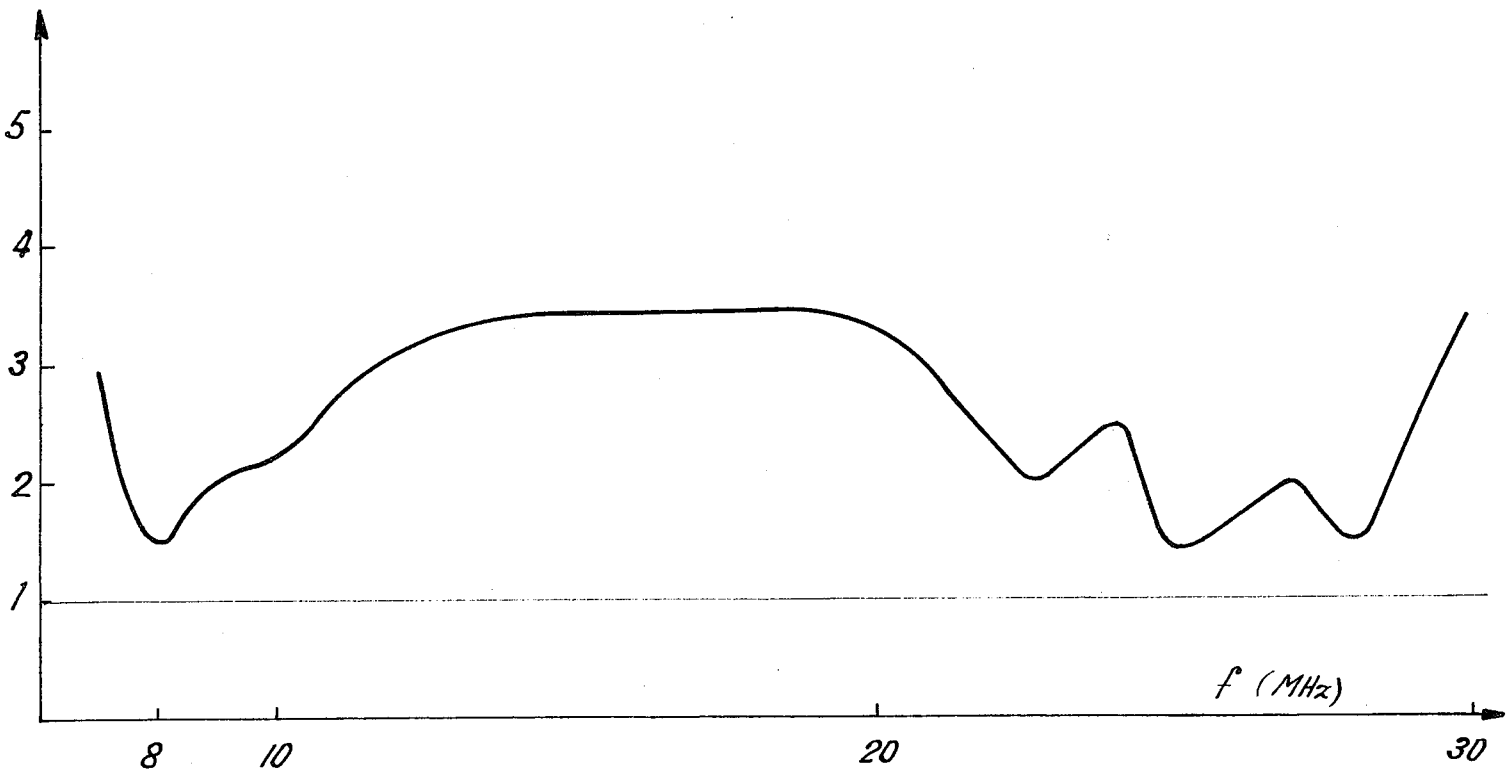
FIG. 5 is the standing wave ratio curve for an antenna of the same dimensions as the antenna of FIG. 3, and designed in accordance with the invention.
Figure 6:
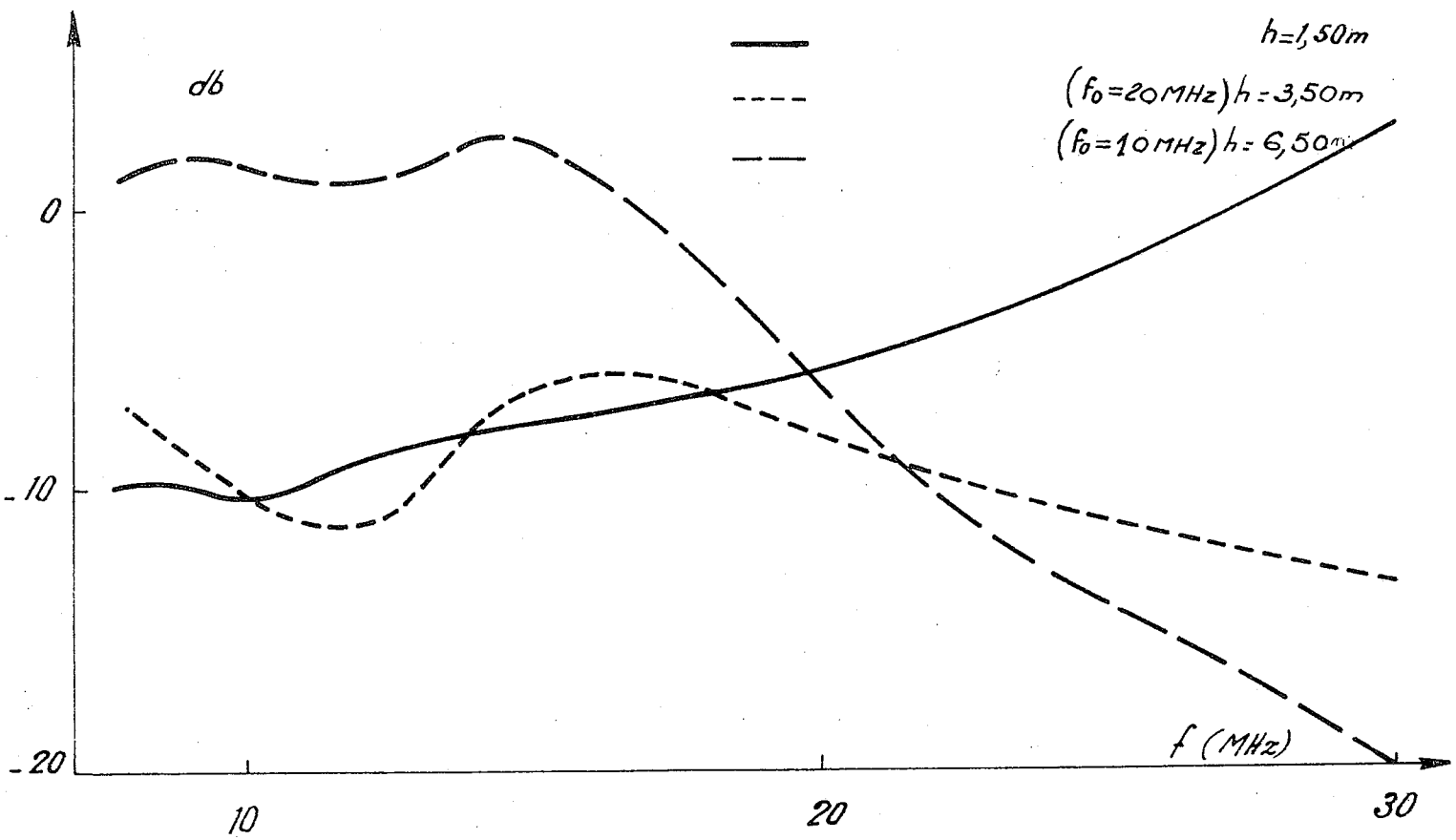
FIG. 6 illustrates a comparison of the effective height of the antenna according to the invention with that of FIG. 1 and with a reference monopole tuned to the central frequency of the band to be covered.

FIGS. 5 and 6 relate to the antenna of FIGS. 3 and 4. The curve of FIG. 5 illustrates the variations of the standing wave ratio in the same way as FIGS. 1, 2 and 8. It will be seen that, in the range from 8 to 30 MHz, the standing wave ratio stays between 3.5 and 1.5 for a relative bandwidth of about 300 %. The curves of FIG. 6 allow comparison between the effective heights of two prior art antennas in the range from 8 to 30 MHz, and that of the antenna according to the invention. As is well known, the effective heights are an indication of the gain of an antenna. The solid-lined curve represents the effective height of the antenna according to the invention (geometrical height $h = 1.5$ m), of which the standing wave ratio characteristic is shown in FIG. 5. The short-dashed curve corresponds to a monopole antenna of a length of 3.50 meters (tuned to 20 MHz)

with compensation of the tuning by an automatic unit. The long-dashed curve illustrates the effective height of a quarter-wave monopole antenna having a geometrical height of 6.50 meters (tuned to 10 MHz), of which the tuning is also automatically compensated in the range with the aid of an automatic unit. As is apparent, the antenna according to the invention, the overall dimensions of which are about one-quarter of that of the monopole antenna tuned to 10 MHz, has a greater effective height than this antenna between 20 and 30 MHz. Between 8 and 20 MHz, the maximum loss of effective height in relation to this antenna is 12 dB. The gain in relation to an antenna tuned to 20 MHz, corresponding to the short-dashed curve, is substantially nil from 8 to 20 MHz, while it reaches 16 dB at 30 MHz. It is to be understood that these measurements were made without any trimming of the tuning of the antenna of the invention in the whole range.

Figure 7:
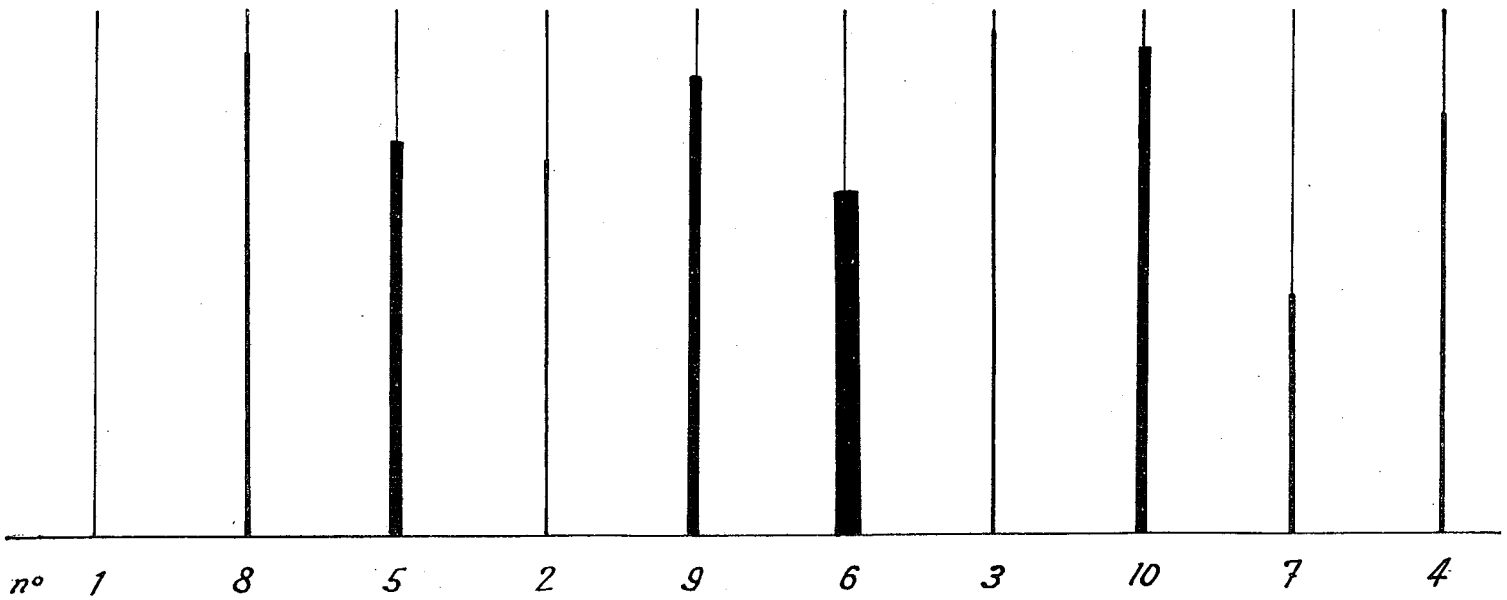
FIG. 7 is a developed view of a variant of the invention.

FIG. 7 illustrates a second embodiment of an antenna according to the present invention, operating in the range from 20 to 80 MHz, i.e. covering two octaves. The uniform length of the rods is 900 mm. FIG. 7 is a developed view of the ten rods loaded by ferrite cores. The characteristics of the cores are tabulated in the following Table II. The construction is similar to that of the preceding example.

TABLE II

| Rod rank N | $F^N$(MHz) | Material $\mu$ | Material Q | Core dimensions $\phi$ mm | Core dimensions H mm |
|---|---|---|---|---|---|
| 1 | 80.000 | — | — | — | — |
| 2 | 68.580 | 15 | 200 | 3 | 645 |
| 3 | 58.790 | 15 | 200 | 3 | 870 |
| 4 | 50.397 | 15 | 200 | 6 | 730 |
| 5 | 43.203 | 15 | 200 | 10 | 670 |
| 6 | 37.035 | 15 | 200 | 20 | 585 |
| 7 | 31.748 | 30 | 250 | 6 | 410 |
| 8 | 27.216 | 30 | 250 | 6 | 825 |
| 9 | 23.331 | 30 | 250 | 10 | 790 |
| 10 | 20.000 | 30 | 250 | 10 | 840 |

Figure 8:
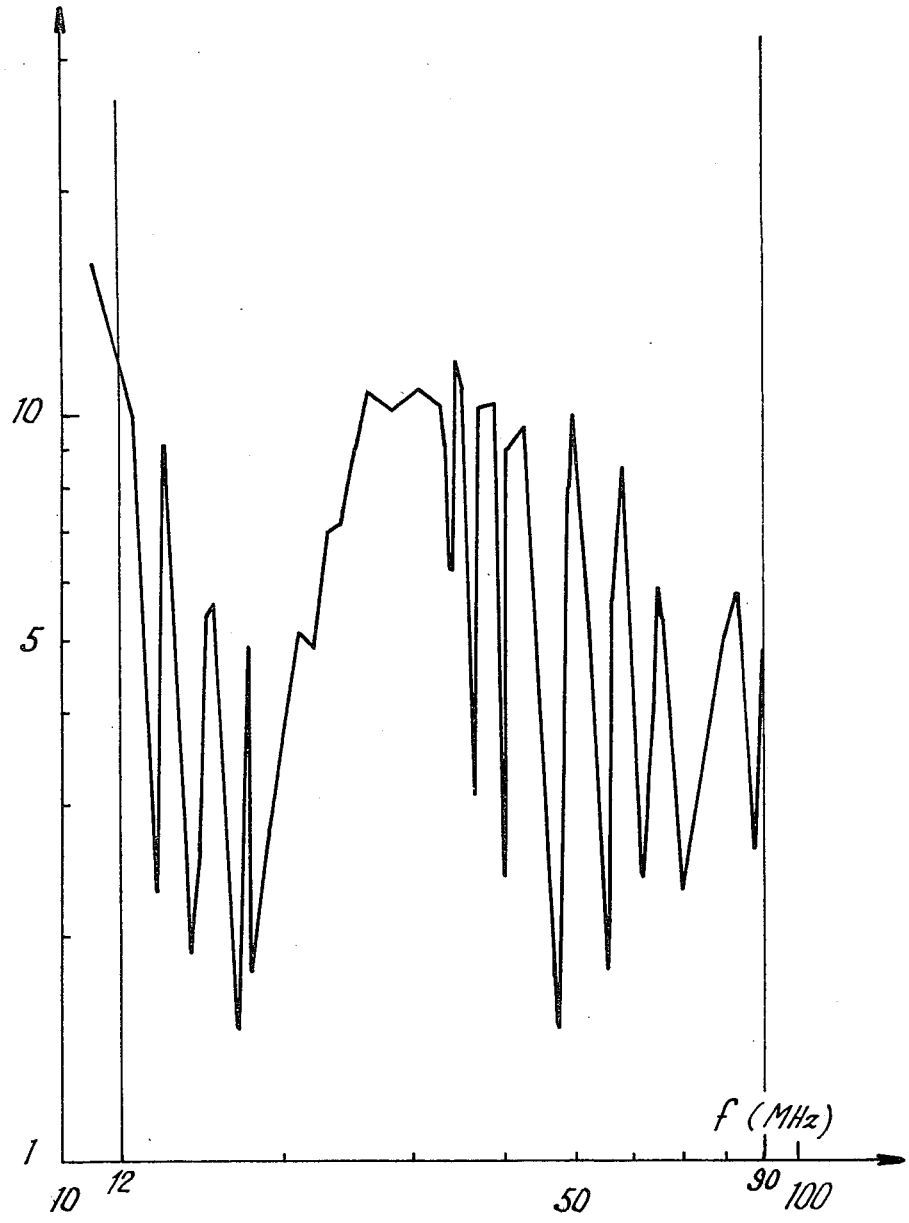
FIG. 8 is a curve illustrating the standing wave ratio of the antenna of FIG. 7.

FIG. 8 illustrates the variation of the standing wave ratio of the embodiment of FIG. 7. This curve is given for comparison with FIGS. 1 and 2. As will be apparent, assuming a standing wave ratio of 12 as in the preceding cases, it is possible to use the antenna between 12 and 90 MHz, which corresponds to a bandwidth of 3 octaves, without matching of the antenna.

The two examples given in the foregoing concern antennas whose rods have the same geometrical length. This characteristic is not essential to the invention. In some cases it is advantageous to use rods of different lengths. The mechanical cohesion of the loaded rods constituting the antenna may be ensured by moulding the whole assembly in a volume of dielectric foam, the density of which is such that the dielectric constant of the form is in the neighbourhood of unity.

Figure 9:
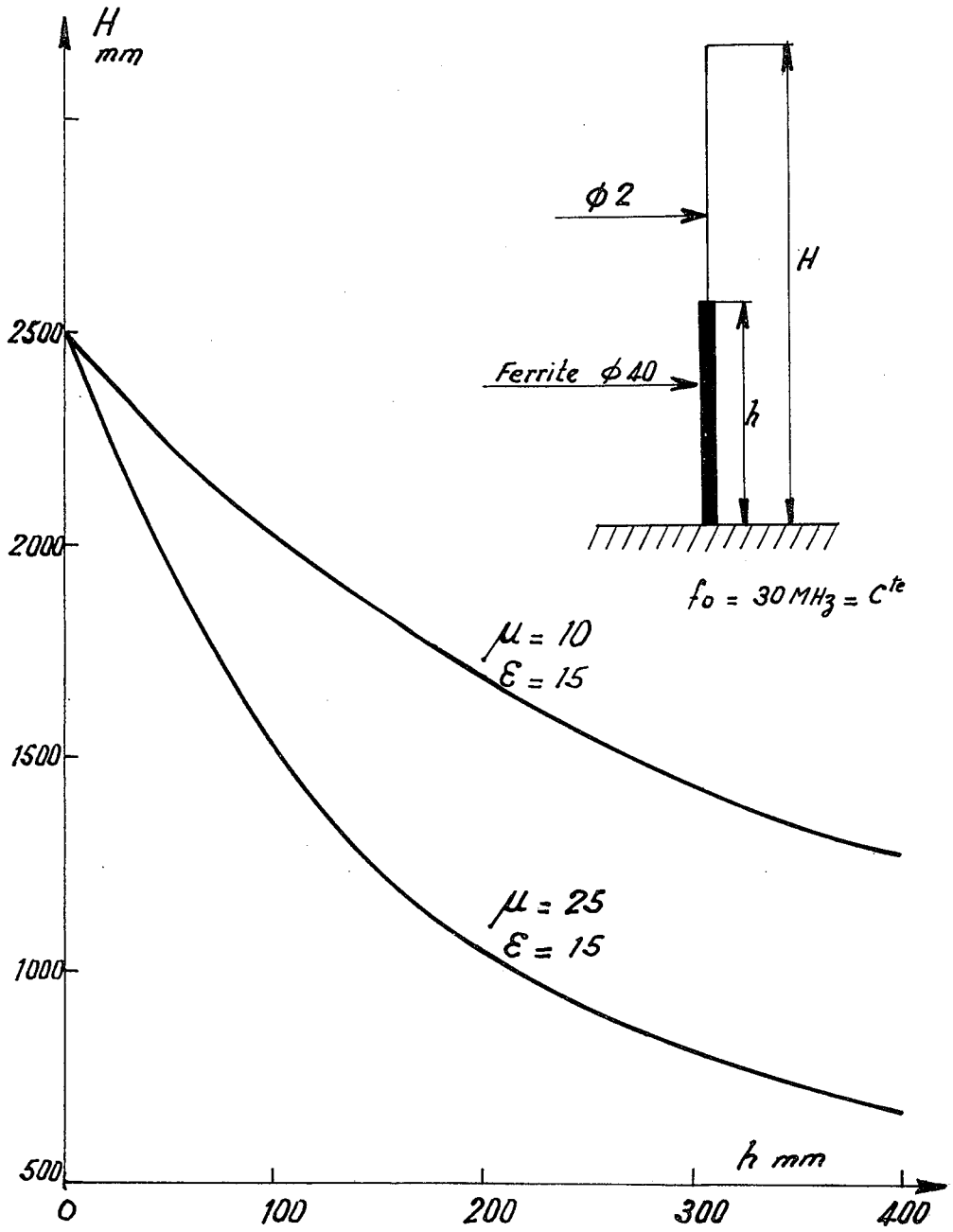
FIG. 9 shows experimental curves.

A broadband antenna according to the invention is calculated as follows: the operating frequency range is fixed by the user, so as the maximum overall dimensions, or at least the maximum length of the rods. The frequency band to be covered and the maximum length of the rods having been determined, the designer chooses the number of rods in accordance with the gain, which is also preset. He then calculates the resonance frequencies of each rod, with due regard to the law of formation of the series constituted by the values of the frequencies. The series of values having been established, the designer selects the material having the lowest losses at the said frequencies. As has been shown by the two foregoing examples, it happens that a single material does not behave satisfactorily at the different frequencies thus selected. It may then be necessary to select two or more different materials for the manufacture of the cores of the different rods. The dimensions of the core constituting the load of a rod are experimentally determined for a given "rod-material" pair and a given position of the core along the rod. In FIG. 9, there are shown the measured values of the height $h$ of cores whose diameter is fixed at 40 mm and which surround a conductor having a diameter of 2 mm and a variable length H, in order to obtain a resonance frequency of 30 MHz. The upper curve corresponds to a ferrite characterized by a permeability of 10 and a permittivity of 15, and the lower curve to a ferrite having a permeability of 25 and a permittivity of 15. As will be apparent, it is possible by adding a load to reduce the mechanical height H of the whip (theoretical value 2.5 m) by 60 % with the first material and by 250 % with the second, while keeping the resonance frequency $f_0$ constant. The cartridge in the upper right-hand corner of the sheet represents the experimental arrangement.

With due regard to certain mechanical requirements (the height of the core cannot be greater than that of the rod, the diameter of the core cannot be more than one-half the distance between two successive rods, the weight of material constituting a load is advantageously a minimum for reasons of the total weight of the antenna and the cost, etc.), the parameters $h$ and $\phi$ defining the cores are fixed within a certain interval. Table III indicates the values of the diameter $\phi$ corresponding to 30 MHz with $h$ constant at 400 mm. In the foregoing, the electromagnetic characteristics ($\mu$, $\epsilon$) of the materials used have been chosen as a function of the losses which they present at the resonance frequency of each of the rods. However, as has been explained in the aforesaid U.S. Pat. No. 3.611.390 and in the French Pat. No. 1.590.709, if the load of each whip is made of a material whose electromagnetic characteristics obey the law:

$$L_1C_1 = \frac{1}{16L^2} \times \frac{1}{f^2} \qquad (1)$$

where $L_1$ and $C_1$ are the linear inductances and capacitances of the loaded rod, L is the mechanical length, f is the operating frequency, the bandwidth of each of the rods is widened and the band can be covered by a smaller number of rods. The relation (1) may be obtained by spontaneous variation of the characteristics with the frequency or by polarisation by means of a magnetic field established by a control current. In the first case, the selection of the material constituting the load is conditioned by the curves representing the variation of the permeability and the permittivity as a function of the frequency, which are issued by the manufacturers. The Applicants have shown in FIGS. 2, 4 and 5 of French patent no. 1.590.709 filed on Sept. 30th, 1968, curves representing the variation of the permeability of ferrite commercially sold as type 2101 between 0 and 30 MHz (the permittivity of this material remains constant) and the variation of the permittivity of ferrite commercially sold as type 1008 in the same band (the permeability of this material is constant in the range) and the curves representing the variation of the permeability and the permittivity of the 1401 type ferrite in the range 0 – 1 MHz. These examples, which concern materials manufactured by the Applicants, are given by way of illustration having no limiting character.

However, it is difficult to find materials which exhibit simultaneously properties meeting condition (1) and low losses in a frequency interval covering 2 or 3 octaves.

TABLE III

| $\phi_F$ mm | H mm | Ferrite |
|---|---|---|
| 10 | 1040 | $\mu = 100$ |
| 20 | 860 | $\epsilon = 15$ |
| 40 | 660 | |

What we claim:

1. A broadband multi-rod antenna comprising a plurality of loaded shortened monopoles supported in parallel relation to each other spaced equidistantly around the circumference of an imaginary cylinder, the resonant frequency of adjacent ones of said monopoles being different.

2. An antenna as defined by claim 1 in which said monopoles are so arranged with respect to each other that if in a plane normal to said monopoles, straight lines drawn to connect monopoles in the order of the value of their resonant frequencies, define a star within said cylinder having a number of points equal to the number of monopoles.

3. An antenna as defined by claim 1 in which the different resonant frequencies of said monopoles are related to each other in a geometrical progression.

4. An antenna as defined by claim 1 in which the different resonant frequencies of said monopoles are related to each other in a logarithmic progression.

5. An antenna as defined by claim 1 in which the loads of said monopoles are cylindrical sleeves made of low loss materials with at least one electrical characteristic varying in accordance with frequency.

6. An antenna as defined by claim 1 in which said monopoles are of the same geometrical length.

7. An antenna defined by claim 1 in which a shorting sleeve is located at the driven end of each monopole.

* * * * *